United States Patent [19]

Saint

[11] 4,025,083

[45] May 24, 1977

[54] BABY WALKER

[75] Inventor: David Saint, Elverson, Pa.

[73] Assignee: Graco Metal Products, Inc., Elverson, Pa.

[22] Filed: Sept. 23, 1975

[21] Appl. No.: 615,915

[52] U.S. Cl. ..... 280/87.05; 248/439; 297/5; 403/102

[51] Int. Cl.[2] ..... B62B 7/10

[58] Field of Search ..... 280/87.02 W, 87.02 R, 280/87.05; 403/102, 95, 96; 2 48/439; 272/70.3; 297/5, 6

[56] References Cited

UNITED STATES PATENTS

| | | | |
|---|---|---|---|
| 1,326,921 | 6/1920 | Dzimitowicz | 297/5 |
| 3,504,927 | 4/1970 | Seki | 297/5 X |
| 3,796,430 | 3/1974 | Sudo | 297/5 X |

*Primary Examiner*—Joseph F. Peters, Jr.
*Assistant Examiner*—John A. Pekar
*Attorney, Agent, or Firm*—Z. T. Wobensmith, 2nd; Z. T. Wobensmith, III

[57] ABSTRACT

A baby walker is disclosed which has a tray with an opening within which the baby is seated, the tray having a seat supported thereby below the opening, the tray being supported from a base frame by foldable legs, the base frame in turn being carried on casters.

9 Claims, 13 Drawing Figures

Fig. 6.
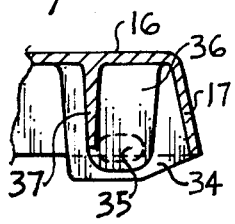
Fig. 3.
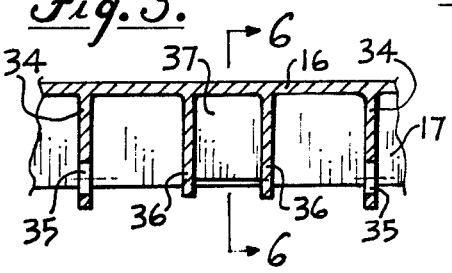
Fig. 9.
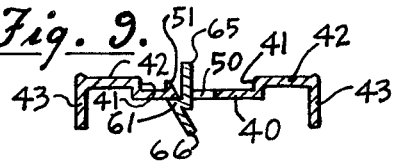
Fig. 11.
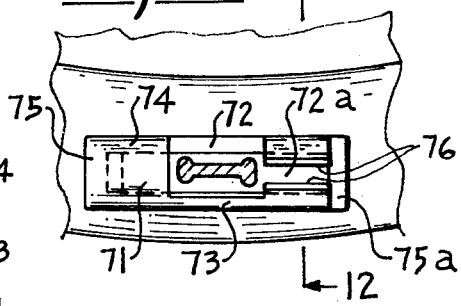
Fig. 7.
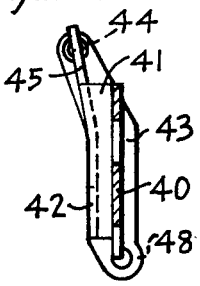
Fig. 4.
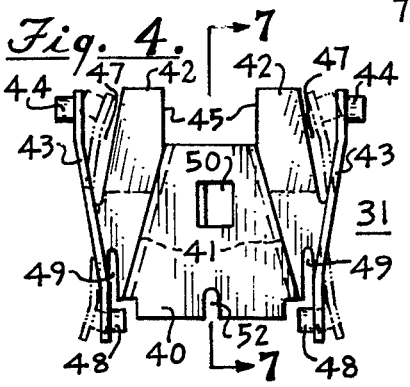
Fig. 13.
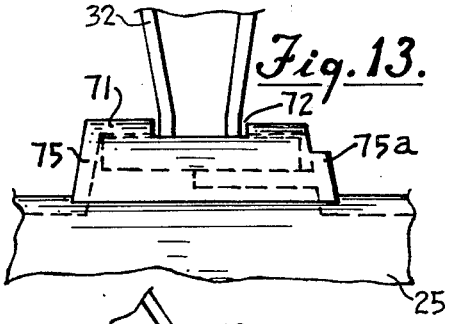
Fig. 8.
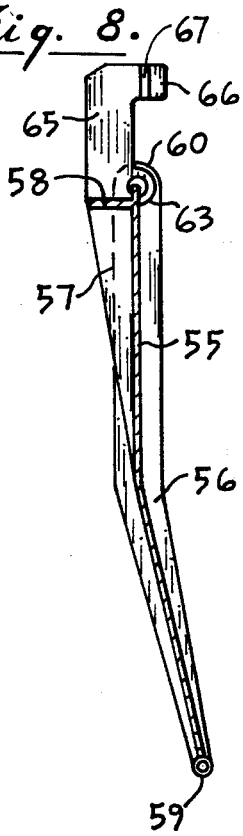
Fig. 5.
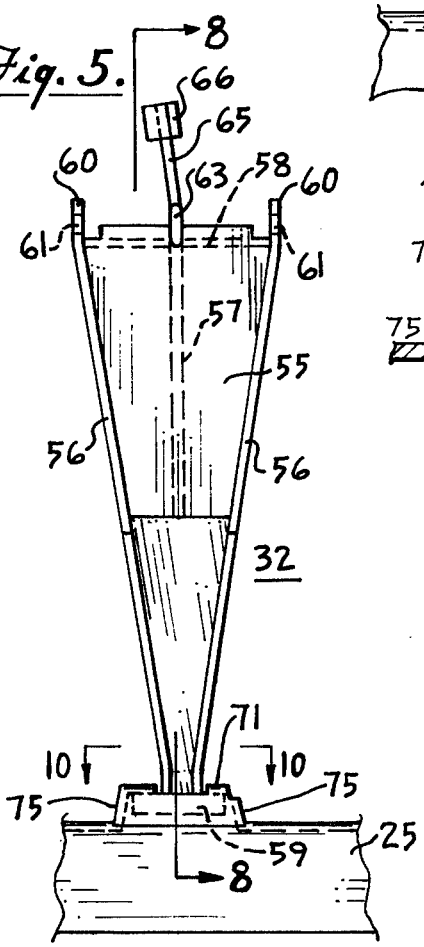
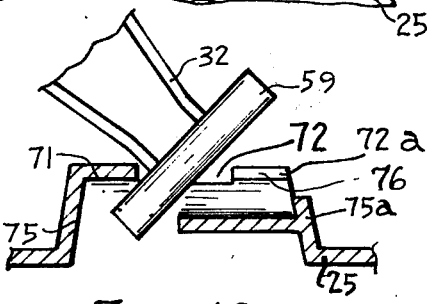
Fig. 10.
Fig. 12.
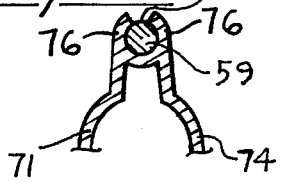

BABY WALKER

BACKGROUND OF THE INVENTION

1. Field of the Invention

This invention relates to baby walkers and more particularly to a baby walker which has collapsible legs for storage.

2. Description of the Prior Art

It has heretofore been proposed to provide baby walkers which include legs that are collapsible. In Webber, U.S. Pat. No. 1,342,518, the legs are of fixed length but are pivotally mounted at their ends for collapsing. The U.S. Pat. Nos. to Knight 1,141,123, Lyon 1,223,707, Dzimitowicz 1,326,921 and Drinosky 1,688,922 show telescoping legs which are difficult to contract and expand and to retain in expanded condition particularly after repeated operations. The U.S. Pat. Nos. to Seki 3,504,927, and Sudo 3,796,430 show legs having pivots intermediate their ends for folding, these being made of wire, or of rods and requiring complex hinging provisions to avoid injury to the user when in extended condition.

Collapsible legs of various types have also heretofore been proposed for other purposes, including those shown in the U.S. Pat. Nos. to Monkiewicz 581,486, Bailey 629,286, and Krueger, 3,359,729.

The baby walkers of the collapsible type heretofore available had various shortcomings including excessive cost, difficulty of initial assembly and of folding for storage or of setting up for use, as well as complex locking arrangements which are difficult to understand and/or operate.

SUMMARY OF THE INVENTION

In accordance with the invention a collapsible baby walker is provided which has a molded tray of synthetic plastic material with an opening interiorly of the periphery within which the baby is seated and supported from the tray, the tray being supported above a base frame by a plurality of foldable legs, preferably also of molded synthetic plastic, the base frame being carried on casters to facilitate movement of the walker by the baby, the legs being of simple yet sturdy construction with locking members whose operation is simple and easy for a parent to understand.

It is the principal object of the invention to provide a baby walker which is strong and rugged, easily assembled from its component parts, easy to fold and to set up for use, and which has hinged legs with simple but effective locking elements.

It is a further object of the invention to provide a baby walker of the character aforesaid which is constructed principally of non-corrosive materials, and specifically synthetic plastics, not requiring painting or other protective finishing, and which can be easily kept in clean condition.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 3 is a fragmentary vertical sectional view, enlarged, taken approximately on the line 3—3 of FIG. 1 but with the upper leg section removed therefrom;

FIG. 4 is a front elevational view of the upper leg section;

FIG. 5 is a front elevational view of the lower leg section in assembled relation to the base frame;

FIG. 6 is a fragmentary vertical sectional view of a portion of the tray taken approximately on the line 6—6 of FIG. 3;

FIG. 7 is a vertical sectional view of the upper leg section, taken approximately on the line 7—7 of FIG. 4;

FIG. 8 is a vertical sectional view of the lower leg section taken approximately on the line 8—8 of FIG. 5;

FIG. 9 is a horizontal sectional view, enlarged, taken approximately on the line 9—9 of FIG. 2;

FIG. 10 is a vertical sectional view, taken approximately on the line 10—10 of FIG. 5 and showing initiation of the connection of one of the lower leg sections to the bottom frame;

FIG. 11 is a horizontal sectional view taken approximately on the line 11—11 of FIG. 5 showing one of the lower leg sections in connected position;

FIG. 12 is a transverse vertical sectional view taken approximately on the line 12—12 of FIG. 10 and FIG. 13 is a fragmentary view in elevation of the lower leg section and its connection to the base frame.

Figure 1:
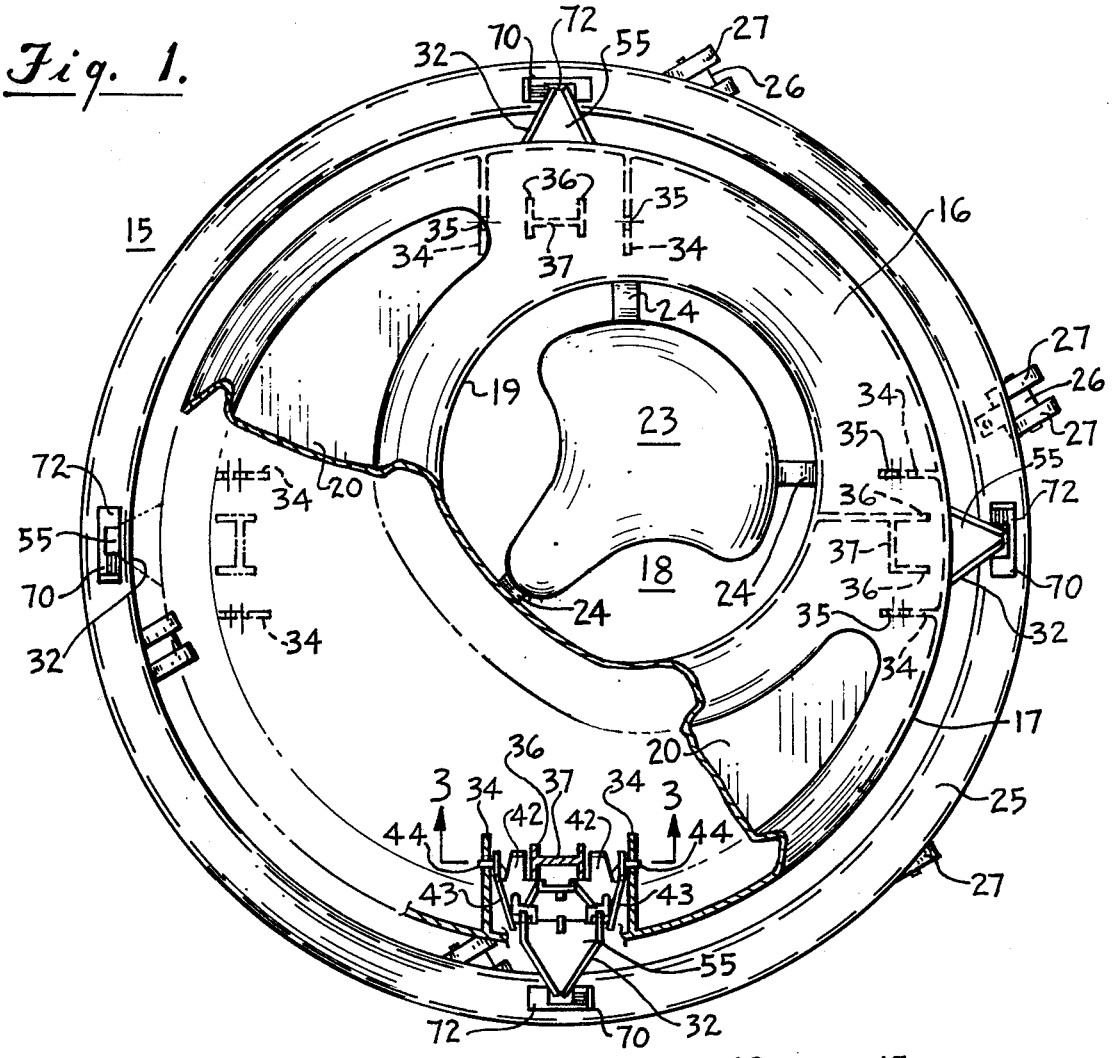
FIG. 1 is a top plan view of a baby walker in accordance with the invention, parts being broken away to show the details of construction.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings, the baby walker in accordance with the invention includes a tray 15 of generally circular shape in plan with a horizontal top wall portion 16 having a downwardly and outwardly extending peripheral rim 17. An eccentrically disposed vertical opening 18 for reception of the child is provided surrounded by an inwardly inclined downwardly extending rim 19. Depressed below the level of the top wall portion 16 and extending in front of and around the side of the baby a flat bottom tray well 20 is provided for the retention of toys, a cup, a dish or the like.

A seat 23, of any desired type, is provided the specific seat, forming no part of the invention. The seat 23 is shown as supported by straps 24 which are preferably resiliently carried by the tray 15 by supports (not shown).

A base frame 25 is provided, preferably of inverted U-shape and molded of synthetic plastic material with a plurality of supporting casters 26 mounted thereon for swinging movement in a horizontal plane and with pairs of wheels 27 extending below the base frame 25.

The tray 15 is supported above the base frame 25 by a plurality of legs 30, four being preferred. Each of the legs 30 has an upper leg portion 31 and a lower leg portion 32 and the leg portions 31 and 32 are preferably molded of synthetic plastic.

In order to provide a pivotal mounting for the upper leg portion 31 the tray 10 has a pair of spaced pivot lugs 34 extending vertically downwardly from the top wall portion 16 and integral therewith. The lugs 34 have pivot openings 35 therethrough of oval shape for purposes to be explained. Intermediate the lugs 34 a pair of spaced vertical abutments 36 are provided with a vertical brace plate 37 connected thereto and integral with the tray 15 for stiffening.

The upper leg portion 31 (see FIGS. 4, 7 and 9) has a central plate portion 40 with upwardly converging interior ribs 41 therealong from which side plate portions 42 extend in supporting relation to elongated pivot carrying plates 43. The plates 43 have upper outwardly extending axially aligned horizontal pivots 44 for engagement in the pivot openings 35. The side plate portions 42 have inner spaced abutment edges 45 for engagement with the outer faces of the abutments 36 for limiting sidewise movement of the upper leg portions 31 and have slots 47 to permit springing the pivots 44 inwardly to the dotted positioning shown in FIG. 4, to facilitate their insertion into the pivot openings 35.

The pivot carrying plates 43 also have lower inwardly extending axially aligned horizontal pivots 48 and the plate portions 42 have lower slots 49 to permit outward springing to the dotted positions shown in FIG. 4 for assembly.

The plate portion 40 has a latch opening 50 therethrough with a guide tongue 51 therealong and at its lower edge has a retaining slot 52.

The lower leg portion 32 (see FIGS. 5 and 8) has a central web portion 55, converging from the top to the bottom, with side flanges 56, a central reinforcing rib 57, an upper transverse end rib 58 and a lower end coupling 59.

The side flanges 56 have parallel extensions 60 with aligned pivot openings 61 for the reception and engagement of the pivots 48. The web portion 55 and rib 58 have a central projection 63 for engagement in the retaining slot 52 to prevent relative sidewise movement of the upper and lower leg portions 31 and 32 when the pivots 48 are engaged in their pivot openings 61.

The lower leg portion 32 also has a resilient latch lever 65 with a locking tongue 66 having a holding portion 67 insertable through the opening 50 for resiliently held releasable locking engagement with the plate portion 40 (see FIG. 9).

The base frame 25, on the upper face thereof, is provided with a plurality of sockets 70 for the reception and retention of the lower end couplings 59 of the lower leg portions 32. The sockets 70 have a wall portion 71 with a slot 72, a closed front wall 73, a rear wall 74, open at the slot 72, a horizontal slot extension **72*a*, a closed end wall 75, and partially closed end wall 75*a*. Disposed along the slot 72*a* are resilient snap fingers 76 (see FIG. 12). As shown in FIGS. 10, 11, 12 and 13, the end couplings 59 are tilted and inserted at initial assembly from the top through the slot 72 and, downwardly past the fingers 76 with one end of the coupling 59 at the wall 75 and the other end at the wall 75*a* to prevent displacement in assembled condition of the couplings 59 in the sockets 70.**

The construction of the legs 30, with their upper leg portions 31 pivotally mounted to the tray 15, their lower leg portions 32 pivotally mounted in the sockets 70, with the upper and lower leg portions 31 and 32 pivotally connected by the pivots 48, and with the upper and lower leg portions 31 and 32 normally held in locked position by the engagement of locking tongues 66 (see FIG. 9) provides for a rigid support of the tray 15 and a support of the seat 23 for normal use by the child.

The child seated on the seat 23 can use the walker for exercise and propulsion.

Figure 2:
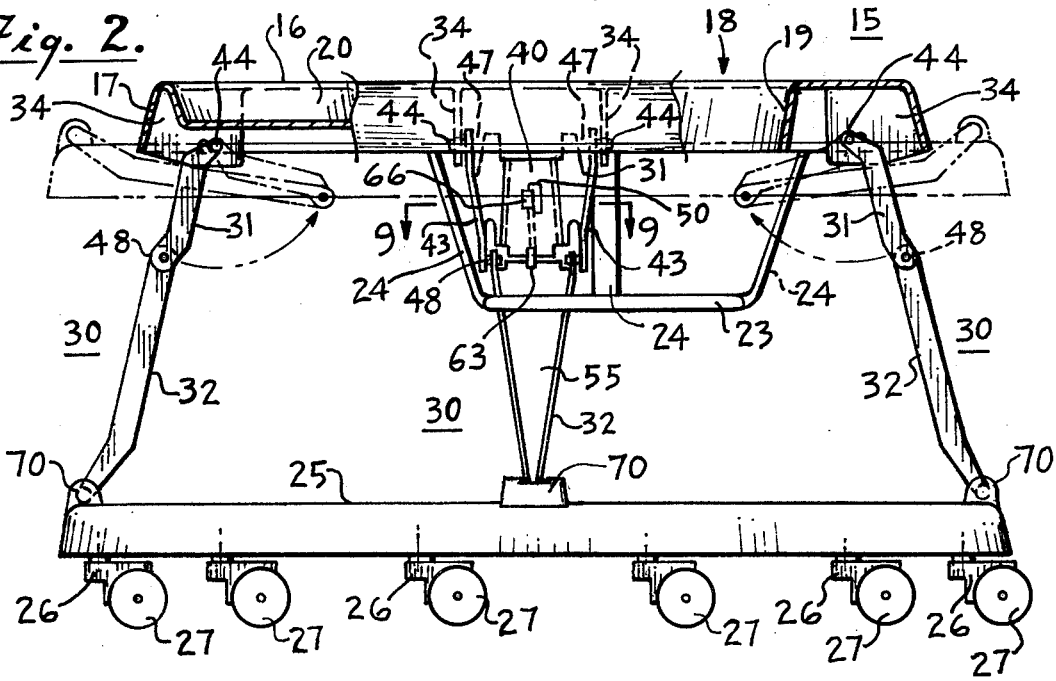
FIG. 2 is a side elevational view of the baby walker of FIG. 1, parts being broken away to show the details of construction and with the folded position for storage being indicated in broken lines.

If it is desired to collapse the walker in assembled condition for shipping or for storage this can be readily accomplished by releasing the locking tongues 66 of each of the legs 30 and folding the leg portions 31 and 32 to collapsed positions as illustrated in FIG. 2, thereby moving the base frame 25 close to the tray 15.

It will thus be seen that a walker is described with which the objects of the invention are attained.

I claim:

1. A baby walker comprising a tray having an opening and a seat below said opening, lug means on said tray, a base frame, and legs for supporting said tray from said base frame, said legs each having an upper leg portion pivotally readily detachably connected by pivots to said lug means and including a central plate engaged by abutments carried on said tray thereby restraining the tray from transverse movement, a lower leg portion pivotally detachably connected at its upper end to said upper leg portion, pivotally connected at its lower end to said base frame and with a projection for engagement in said central plate to restrain sidewise movement in locked condition, a resilient locking tongue carried by said lower leg portion for releasably engagement with said central plate for normally retaining said upper and lower leg portions in extended and supporting relation but permitting folding of said legs and movement of said base frame in closely spaced relation to said tray.

2. A baby walker as defined in claim 1 in which said legs are of molded synthetic plastic material.

3. A baby walker as defined in claim 1 in which said upper leg portions are connected to said tray by axially resiliently supported pivots.

4. A baby walker as defined in claim 1 in which said upper leg portions are connected to said lower leg portions by axially resiliently supported pivots.

5. A baby walker as defined in claim 1 in which said base frame is of molded synthetic plastic material and is supported by a plurality of casters.

6. A baby walker as defined in claim 1 in which said base frame has sockets in which coupling portions of said lower leg portions are received.

7. A baby walker as defined in claim 6 in which said upper leg pivots are resiliently mounted for snapping into engagement with said tray lug portions, said upper leg pivots are resiliently mounted for snapping into engagement with said lower leg pivots, and said sockets have resilient portions for the reception and retention of said lower leg portions.

8. A baby walker as defined in claim 1 in which said lug means includes lug portions on the lower part thereof providing part of the pivotal connections for said upper leg portions.

9. A baby walker as defined in claim 1 in which said tray is of molded synthetic plastic material.

* * * * *